US005622404A

United States Patent [19]

Menne

[11] Patent Number: 5,622,404

[45] Date of Patent: Apr. 22, 1997

[54] COMBINATION SEAT AND STORAGE SYSTEM

[75] Inventor: Robert J. Menne, Forest Lake, Minn.

[73] Assignee: Premier Marine, Inc., Wyoming, Minn.

[21] Appl. No.: 548,026

[22] Filed: Oct. 25, 1995

Related U.S. Application Data

[63] Continuation of Ser. No. 143,183, Oct. 26, 1993, abandoned.

[51] Int. Cl.[6] ..... A47C 7/62

[52] U.S. Cl. ..... 297/188.1; 312/235.5

[58] Field of Search ..... 297/188.01, 188.03, 297/188.08, 188.09, 188.1, 217.1; 312/235.2, 235.5, 327, 328

[56] References Cited

U.S. PATENT DOCUMENTS

| | | | |
|---|---|---|---|
| 747,392 | 12/1903 | Eugster | 297/193 X |
| 863,128 | 8/1907 | Aebi | 16/366 X |
| 1,077,189 | 10/1913 | Curtice | 297/192 X |
| 1,643,715 | 9/1927 | Kleinsmith | 297/193 X |
| 1,769,343 | 7/1930 | Henry | 297/193 |
| 2,950,753 | 8/1960 | Glutoman et al. | 297/193 |
| 3,114,574 | 12/1963 | Pryale | 297/193 |
| 3,600,742 | 8/1971 | Barger | 16/366 |
| 4,002,243 | 1/1977 | Kramer | 16/368 X |
| 4,369,937 | 1/1983 | LaBell et al. | 16/366 X |
| 4,883,317 | 11/1989 | Davenport | 297/193 |

FOREIGN PATENT DOCUMENTS

| | | | |
|---|---|---|---|
| 269414 | 3/1969 | Germany | 297/193 |
| 3327981 | 2/1985 | Germany | 297/192 |

*Primary Examiner*—Laurie K. Cranmer
*Attorney, Agent, or Firm*—Hugh D. Jaeger

[57] ABSTRACT

A combined seating and storage system, particularly adapted for pontoon boats, in which a lid is connected to a storage container by a double pivot hinge which enables the lid to open into a safe vertical orientation in front of the storage container.

18 Claims, 5 Drawing Sheets

COMBINATION SEAT AND STORAGE SYSTEM

This application is a continuation, of application Ser. No. 08/143,183, filed 10/26/93 now abandoned.

BACKGROUND OF THE INVENTION

The present invention relates to combination seating and storage systems and in particular relates to combination seating and storage systems in the field of marine transportation.

It is well known in the field of transportation, and particularly in the boat industry, to provide combination seating and storage systems. An advantage of such systems is an efficient use of the limited available space aboard boats. In a most rudimentary system, a separable lid is placed over a container and can serve as an occupant support surface. Often, such lids have been upholstered to increase the comfort of a passenger. It is also well known to hinge a storage compartment lid from the rear edge of the lid thus allowing the lid to pivot about its rearward edge and ultimately rest against a backrest of the seating/storage compartment. Such a system, while allowing efficient space utilization, suffers from several disadvantages. One significant disadvantage of a rear hinge lid is a tendency on a rocking boat to suddenly slam shut. At the least, slamming shut is inconvenient and could be potentially dangerous to one accessing the storage compartment.

The present invention concerns a combined seating and storage system, including a double pivot hinge, which provides an alternative to the instability problem of a rear hinged lid for combination seating and storage units.

SUMMARY OF THE INVENTION

In a first embodiment, the present invention is a combined seating and storage system which includes a storage container having at least front, rear, left, and right sides, which in turn define an open top. The system further includes a lid having an upper surface suitable as a seating surface, an undersurface, and a double pivot hinge. The double pivot hinge connects the lid to the storage container and includes a first horizontal pivot pin connected adjacent to the top of a front side or front corner of the storage container and a second horizontal pivot pin located between the front and rear edges of the lid on the undersurface of the lid. Preferably, the second pivot is closer to the rear edge of the lid than to the forward edge of the lid. The double pivot hinge also includes a one-piece connecting arm pivotally connected at a first end to the first pivot pin and pivotally connected at a second end to the second pivot pin. The lid can be moved from a closed horizontal position overlying the storage container to an open vertical position in front of the front side of the storage container. This open position allows excellent access to the interior of the storage container. Also, when the lid is in the open vertical position, it is free of a tendency to slam shut.

Preferably, the combined seating and storage system also includes a pocket at the rear of the storage container which is receptive of a rearward portion of the lid and wherein the pocket prevents the rearward portion of the lid from hinging upward in advance of the upward hinging of the front edge of the lid. Most preferably, the pocket is provided in part by the bottom edge of a forwardly directed cushion on the backrest. Preferably, the double pivot hinge includes a pair of spaced apart, parallel connecting arms.

Additionally, the present invention is a double pivot hinge for connecting a lid of a storage container to the storage container and includes a first bracket carrying a first pivot pin, a second bracket carrying a second pivot, and a first one-piece connecting arm having a first end pivotally carried on the first pivot pin and a second end pivotally carried on the second pivot pin. Preferably, the double pivot hinge also includes a third bracket carrying a third pivot pin which is coaxially aligned with the first pivot pin, a fourth bracket carrying a fourth pivot pin coaxially aligned with the second pivot pin and a second one-piece connecting arm having a first end pivotally carried on the third pivot pin and a second end pivotally carried on the fourth pivot pin and means for rigidly linking the first and second one-piece connecting arms in parallel orientation. The rigid linking of the first and second one-piece connecting arms tends to prevent binding between the two one-piece connecting arms of the hinge. Preferably, the first and third brackets are integrally formed high in the right and left sides of the storage container near front corners of the storage container. Preferably, the first and second one-piece connecting arms have opposing offsets adjacent the first and third pivot pins. Additionally and preferably, the one-piece connecting arms include doglegs adjacent to the second and fourth pivot pins to facilitate rotation of the second and fourth pivot pins over center of an axis defined by the first and third pivot pins. In combination, the overcenter balance and mounting of the second and fourth brackets rearward of the midpoint of the lid facilitates stability when the storage container is opened by movement and pivoting of the lid forward of the front edge of the storage container.

DETAILED DESCRIPTION OF THE PREFERRED EMBODIMENTS

Figure 1:
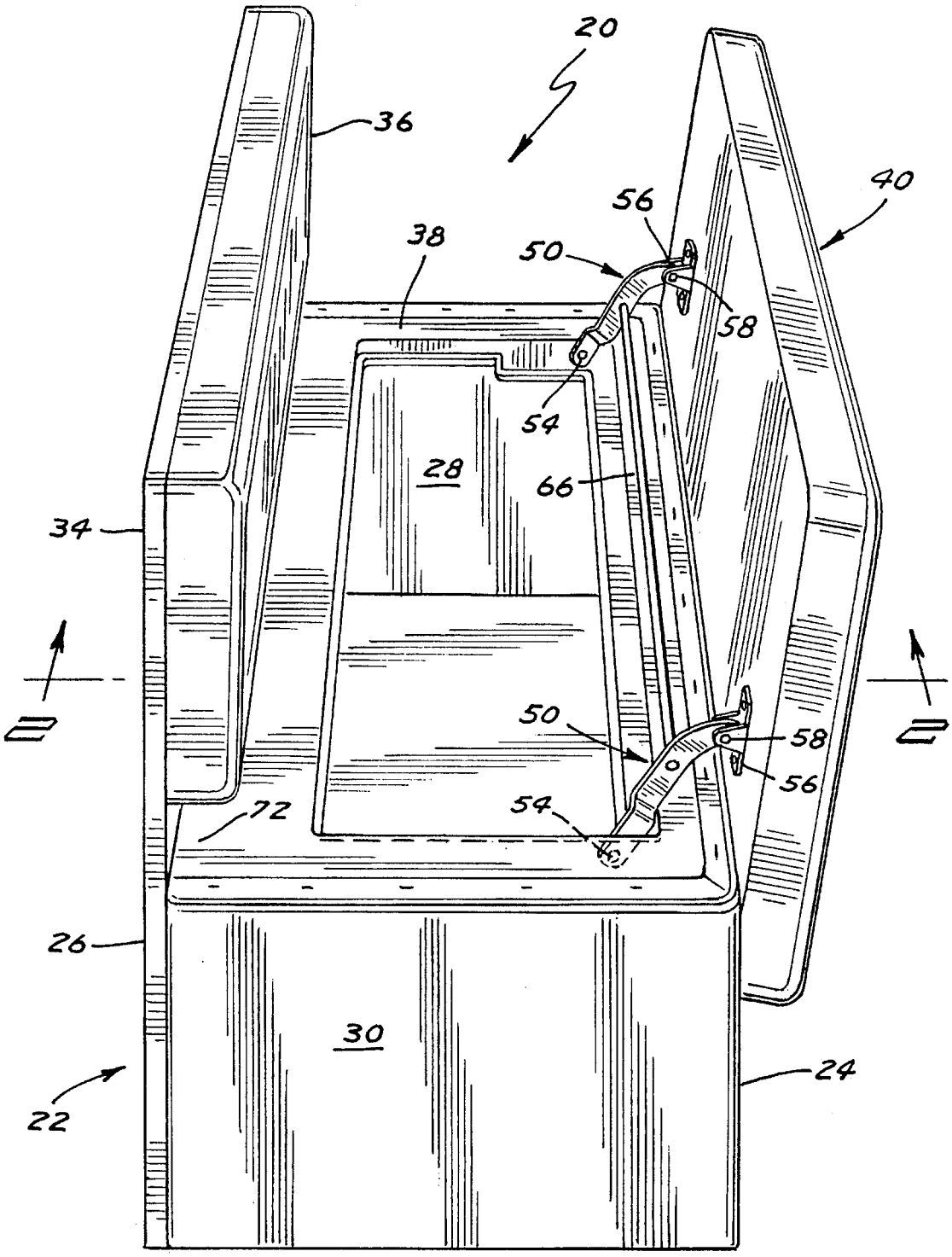
FIG. 1 is a perspective view of the combination seat and storage system of the present invention, with the lid shown in the fully-opened position.

In a first embodiment, the present invention is a combination seating and storage unit 20, as shown in FIG. 1. The unit 20 includes a storage container 22 having a front side 24, a rear side 26, a right side 28 and a left side 30. The unit optionally includes a bottom or floor 32. Preferably, the storage container also includes a back 34 carrying a horizontal cushion 36. Additionally, the unit 20 includes a lid 40.

Preferably, the storage container 22 is formed from rotomolded plastic. However, suitable storage units could be prepared from plywood, preferably marine plywood, aluminum, steel, or other well-known fabrication materials. The lid 40 is preferably formed of plywood, most preferably marine plywood, of a thickness sufficient to support a seated occupant. Alternatively, other building materials such as aluminum, plastic, steel, or wood planking could be suitably employed. The lid 40 and the back 34 are preferably upholstered with well-known foam upholstery material covered with fabric, or most preferably vinyl.

As shown in FIG. 1, the lid 40 is connected to the storage container 22 such that when opened, the lid is oriented vertically and positioned immediately in front of the front side 24 of the storage container 22. This positioning of the lid 40 facilitates excellent access to the interior of the storage container through an open top 38 of the storage container. In such an open position, the lid 40 is extremely stable for reasons which will be apparent from the following discussion.

Figure 2:
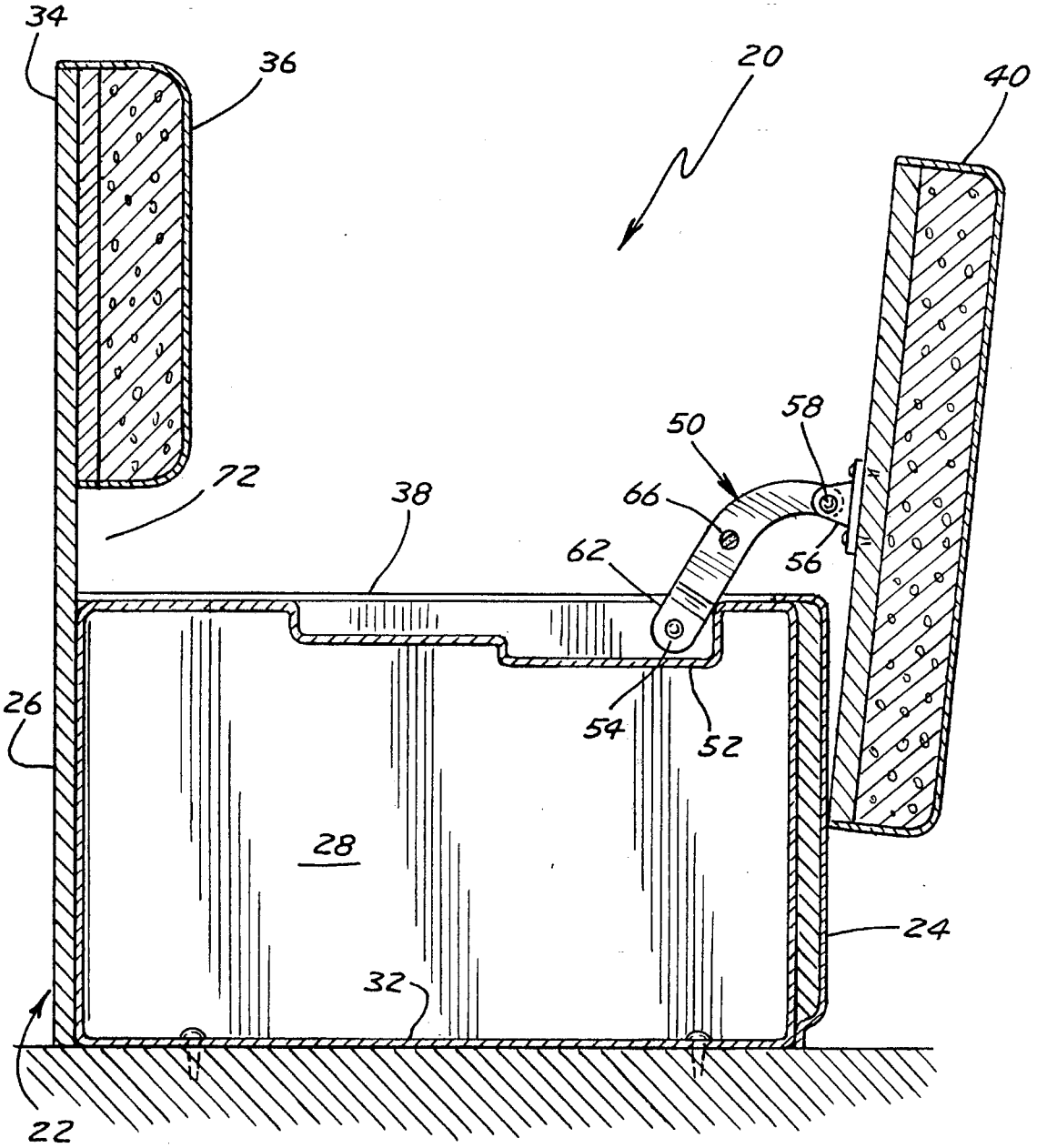
FIG. 2 is a sectional view taken along line 2—2 of FIG. 1 in the direction of the arrows.
Figure 3:
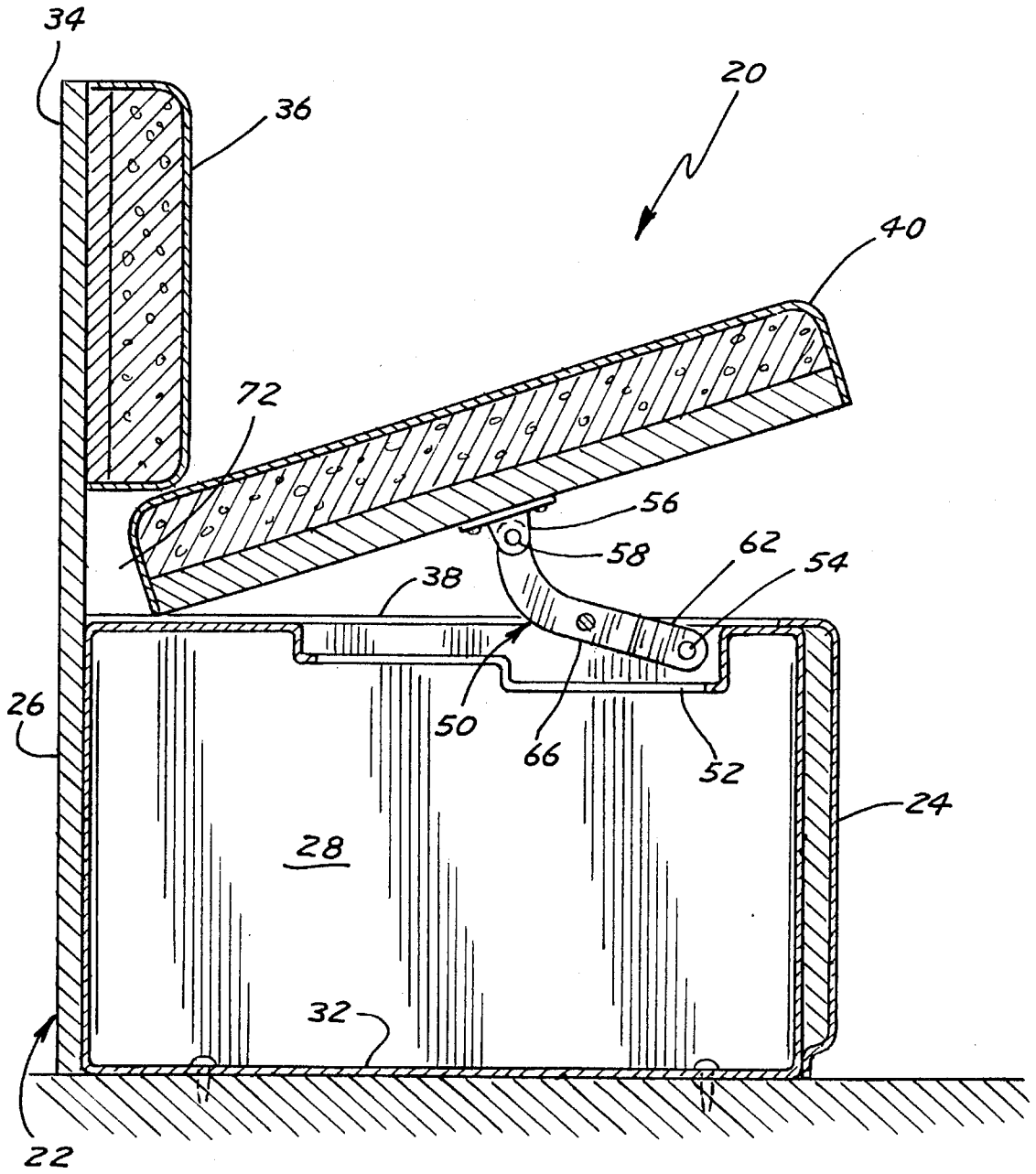
FIG. 3 is a sectional view similar to that of FIG. 2 with lid partially closed.

With reference to FIG. 2, a double pivot hinge 50 connects the lid 40 to the storage container 22. The double pivot hinge 50 includes a first bracket 52, which in a preferred mode is integral with right side 28 at a location adjacent the open top 38 and the front side 24; in other words, near the upper position of a front corner of the container 22. The bracket 52 carries a first pivot pin 54. A second bracket 56 carries a second pivot pin 58. The second bracket 56 is attached to the lid 40 generally adjacent to the midpoint between the front and rear edges of the lid 40 and most preferably slightly rearward of the midpoint of the lid 40.

First and second pivot pins 54 and 58 are each pivotally connected to a one-piece connecting arm 60 at a first end 62 and at a second end 64, respectively. Additionally, the second end 64 of the one-piece connecting arm 60 preferably includes a dogleg or bend 66 adjacent the second end 64. The first and second ends 62 and 64, respectively, are planar and are offset from one another so as to lie in parallel planes. The one-piece connecting arm 60 includes an integral offset portion 68 connecting the first and second ends. Most preferably, the first end 62 has a roughly three-quarters of an inch offset to place the first end 62 in sliding contact with the bracket portion 52 of right side wall 28. The second body 64 of the one-piece connecting arm 60 is therefore offset inward approximately three-quarters of an inch from the right side 28.

In a preferred embodiment, a mirror image of the double pivot hinge just explained is present at the left side 30 of the storage container 22 and at the left side of the one-piece lid 40. Most preferably, the connecting arm 60 on the right side and its equivalent member on the left side are rigidly linked together by connecting means comprising at least one rigid rod, tube or bar 70 which rigidly attaches to the connecting arms and holds them in a parallel relationship. The connecting means 70 thus prevents bending, twisting and binding of the double pivot hinge to assure dependable motion of the lid 40 as it is opened and closed from the storage container 22.

To close the lid 40, the rearward portion of the lid 40 is pivoted rearwardly about pivot pin 58 until it reaches the open top 38 of storage container 22. Next, application of a downward force to the front edge of lid 40 causes the rearwardly edge to slide rearward into a pocket 72 which is generally defined by the lower edge of cushion 36, the lower edge of back support 34 and the rear portion of the open top 38 of storage container 22. The pocket 72 may be alternatively described as a front opening slot or groove at the rear of the open top 38.

Figure 4:
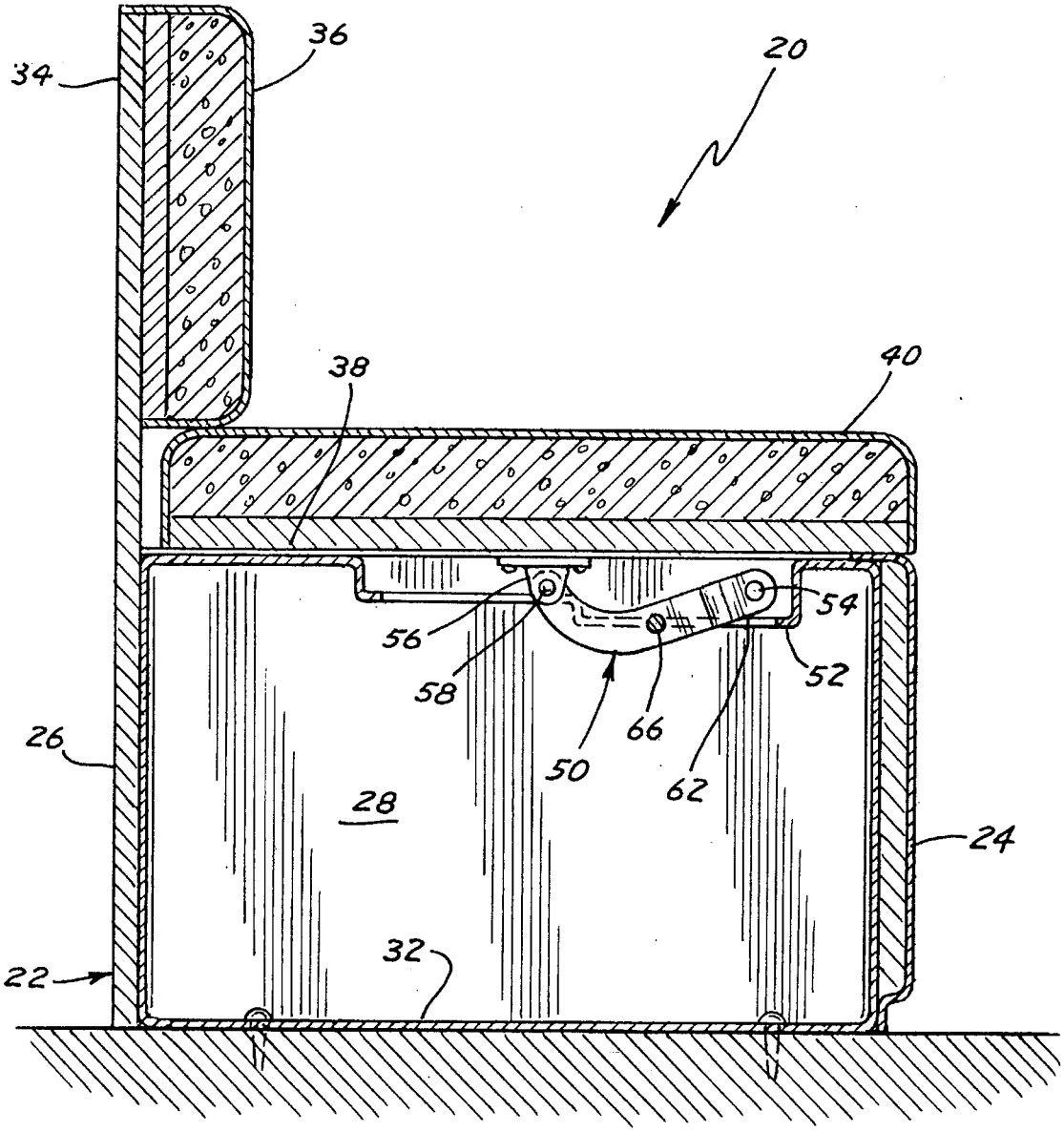
FIG. 4 is a sectional view similar to that of FIG. 2 with the lid fully closed.

As the front of the lid 40 is forced downward, the double pivot hinge 50 moves about pivot pins 54 and 58 to trap the rear edge of the lid 40 within the pocket 72. Ultimately, the configuration shown in FIG. 4 is achieved in which the lid 40 is fully closed over the storage container 22 to provide seating over the storage container 22. It will be evident that due to the capturing effect of pocket 72, the rear edge of the lid 40 cannot rise until the front edge has been lifted and the lid begins to shift upward and forward. Only under the most rigorous rough water conditions is any additional lockdown system required. Such a lockdown system if required is provided at the front edge of the cushioned lid 40.

Figure 5:
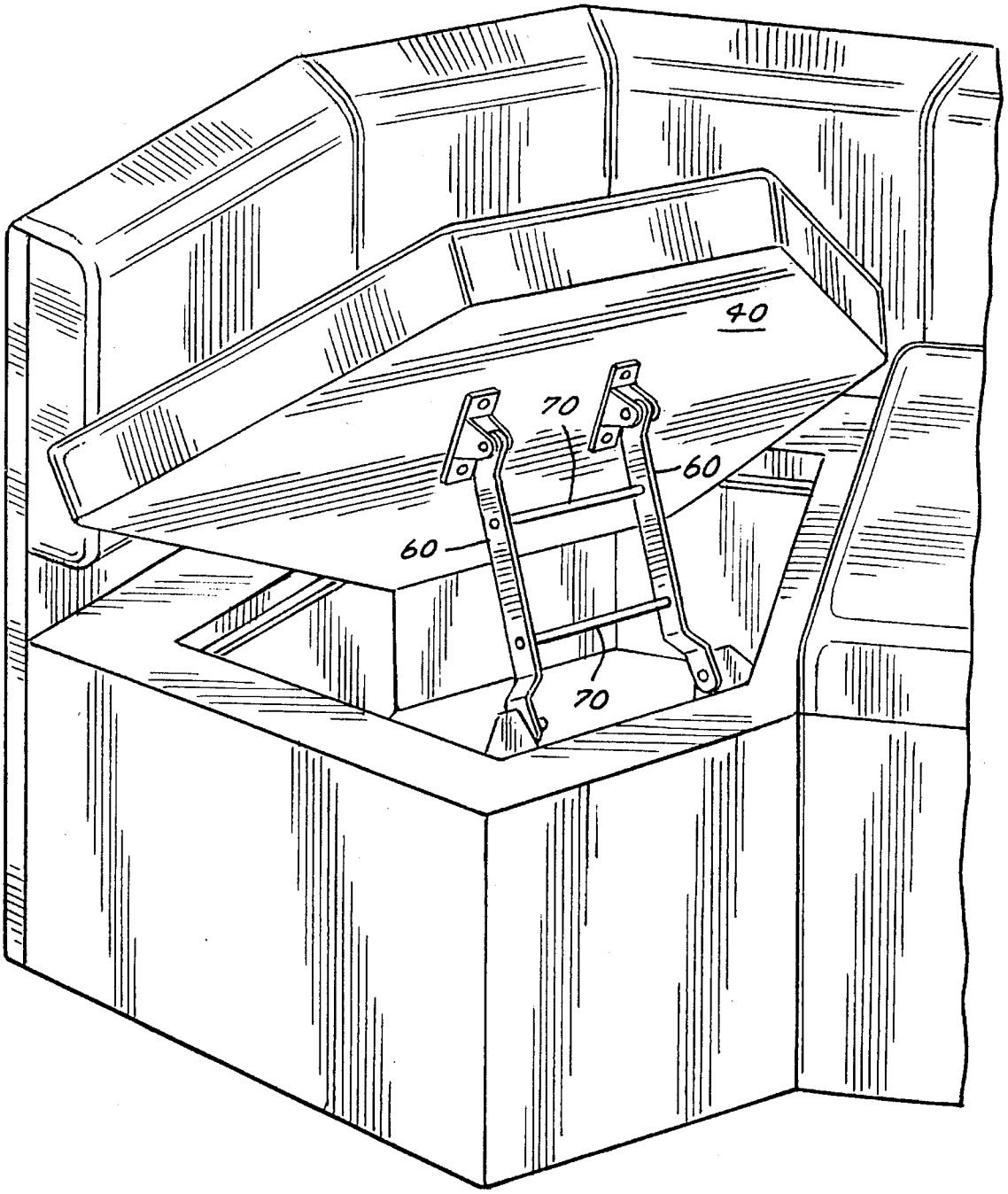
FIG. 5 is a perspective view of the double pivot hinge connecting arm assembly with a six-sided corner embodiment of the combination seating and storage unit of the present invention.

The usefulness of such a seating and storage system is not limited to rectangularly shaped storage containers but may also be used upon alternative shapes, such as a hexagonal corner unit, to provide both seating and storage in a corner of a vessel, such as a pontoon boat, as shown in FIG. 5.

Although the present invention has been described with reference to the preferred embodiments, workers skilled in the art will recognize that changes may be made in form and detail without departing from the spirit and scope of the invention.

What is claimed is:

1. A combined seating and storage system comprising:

a. a storage container having at least a front wall, a rear wall, a left side wall, a right side wall, and an open top;

b. a lid having a front edge, a rear edge, an undersurface, and a seating surface when in a horizontal position atop said storage container and closing said open top of said storage container; and, c. a double pivot hinge connecting said lid to said storage container, said double pivot hinge comprising:

(1) a first horizontal pivot pin affixed to the inside surface of one of said side walls of said storage container near said front wall of said storage container;

(2) a second horizontal pivot pin affixed to said undersurface of said lid between said front and rear edges of said lid; and, (3) a one-piece connecting arm having a first end pivotally connected to said first pivot pin and a second end pivotally connected to said second pivot pin, whereby said lid can be moved from a closed horizontal position in which it closes said open top of said storage container to an open vertical position in front of said front wall of said storage container.

2. The combined seating and storage system in accordance with claim 1, wherein said second horizontal pivot pin is positioned on the undersurface of said lid closer to said rear edge of said lid than to said front edge of said lid.

3. The combined seating and storage system in accordance with claim 1, wherein said second end of said one-piece connecting arm includes a dogleg.

4. The combined seating and storage system in accordance with claim 1, and further comprising, a. a pocket at the rear of said storage container for receiving said rear edge of said lid when said lid is in said closed horizontal position, said pocket preventing said rear edge of said lid from hinging upwardly in advance of upward hinging of said front edge of said lid.

5. The combined seating and storage system in accordance with claim 4, wherein said storage container includes a backrest extending generally upward from said rear wall, and said backrest has a forwardly directed cushion spaced from said open top of said storage container, said backrest, said open top, and said cushion defining said pocket.

6. The combined seating and storage system in accordance with claim 1, wherein said first end of said one-piece connecting arm is planar and lies in a first plane and said second end of said one-piece connecting arm is planar and lies in a second plane parallel to said first plane, and said one-piece connecting arm includes an integral offset portion connecting said first and second ends.

7. The combined seating and storage system in accordance with claim 6, wherein said planar first end of said one-piece connecting arm is closer to said inside surface of said side wall to which said first horizontal pivot pin is affixed than is said planar second end of said one-piece connecting arm.

8. The combined seating and storage system in accordance with claim 1, wherein said double pivot hinge connecting said lid to said storage container further comprises:

a. a third horizontal pivot pin affixed to the inside surface of the other of said side walls of said storage container near said front wall of said storage container;

b. a fourth horizontal pivot pin affixed to said undersurface of said lid between said front and rear edges of said lid; and, c. a second one-piece connecting arm having a first end pivotally connected to said third pivot pin and a second end pivotally connected to said fourth pivot pin.

9. The combined seating and storage system in accordance with claim 8, wherein said first pivot pin is coaxially aligned with said third pivot pin, and said second pivot pin is coaxially aligned with said fourth pivot pin.

10. The combined seating and storage system in accordance with claim 9, and further including means rigidly linking said one-piece connecting arms in parallel relationship to each other.

11. The combined seating and storage system in accordance with claim 10, wherein said means rigidly linking said one-piece connecting arms in parallel relationship to each other comprises a rigid member extending between said one-piece connecting arms and having ends fastened to said one-piece connecting arms.

12. The combined seating and storage system in accordance with claim 10, wherein said means rigidly linking said one-piece connecting arms in parallel relationship to each other comprises a plurality of rigid members extending between said one-piece connecting arms, each one of said plurality of rigid members having ends connected to said one-piece connecting arms.

13. The combined seating and storage system in accordance with claim 8, wherein said second ends of said one-piece connecting arms each includes a dogleg.

14. The combined seating and storage system in accordance with claim 8, wherein said first ends of said one-piece connecting arms are offset from said second ends of said one-piece connecting arms in directions away from each other.

15. The combined seating and storage system in accordance with claim 14, wherein said one-piece connecting arms are mirror images of each other.

16. The combined seating and storage system in accordance with claim 8, wherein said first and third pivot pins are affixed to said side walls of said storage container by brackets formed unitarily with said side walls, and wherein said second and fourth pivot pins are affixed to said undersurface of said lid by brackets attached to said undersurface of said lid.

17. The combined seating and storage system in accordance with claim 8, wherein said side walls of said storage container each make an obtuse angle with said front wall of said storage container, and said rear wall of said storage container has a central portion parallel to said front wall and portions to each side of said central portion which make an obtuse angle with said central portion.

18. A combined seating and storage system comprising:

a. a storage container having at least a front wall, a rear wall, a left side wall, a right side wall, and an open top;

b. a lid having a front edge, a rear edge, an undersurface, and a seating surface when in a horizontal position atop said storage container and closing said open top of said storage container;

c. a double pivot hinge connecting said lid to said storage container, said double pivot hinge comprising:

(1) a first horizontal pivot pin affixed to the inside surface of one of said side walls of said storage container near said front wall of said storage container;

(2) a second horizontal pivot pin affixed to said undersurface of said lid between said front and rear edges of said lid at a location closer to said rear edge of said lid than to said front edge of said lid;

(3) a third horizontal pivot pin affixed to the inside surface of the other of said side walls of said storage container near said front wall of said storage container;

(4) a fourth horizontal pivot pin affixed to said undersurface of said lid between said front and rear edges of said lid at a location closer to said rear edge of said lid than to said front edge of said lid;

(5) said first pivot pin being coaxially aligned with said third pivot pin, and said second pivot pin, and said second pivot pin being coaxially aligned with said fourth pivot pin;

(6) a first one-piece connecting arm having a first end pivotally connected to said first pivot pin and a second end pivotally connected to said second pivot pin;

(7) a second one-piece connecting arm having a first end pivotally connected to said third pivot pin and a second end pivotally connected to said fourth pivot pin;

(8) said second ends of said first and second one-piece connecting arms each including a dogleg;

(9) at least one elongated rigid member extending between said first and second one-piece connecting arms and rigidly linking said first and second one-piece connecting arms together in spaced apart parallel relationship to each other; and,

(10) said first ends of said first and second one-piece connecting arms being offset from said second ends of said first and second one-piece connecting arms in directions away from each other such that the distance between said first ends of said linked-together first and second one-piece connecting arms is greater than the distance between the second ends of said linked-together first and second one-piece connecting arms;

d. a pocket at the rear of said storage container for receiving said rear edge of said lid when said lid is in said horizontal position atop said storage container, said pocket preventing said rear edge of said lid from hinging upwardly in advance of upward hinging of said front edge of said lid; and, e. whereby said lid can be moved from a closed horizontal position in which it closes said open top of said storage container to an open vertical position in front of said front wall of said storage container to provide full, unobstructed access to the interior of said storage container.

* * * * *